United States Patent [19]

Yogo

[11] Patent Number: 4,714,193

[45] Date of Patent: Dec. 22, 1987

[54] SELECTOR VALVE DEVICE

[75] Inventor: Kenji Yogo, Nagoya, Japan

[73] Assignees: Aisin Seiki Kabushiki Kaisha, Kariya; Toyota Jidosha Kabushiki Kaisha, Toyota, both of Japan

[21] Appl. No.: 927,582

[22] Filed: Nov. 6, 1986

[30] Foreign Application Priority Data

Nov. 6, 1985 [JP] Japan ..... 60-248439

[51] Int. Cl.[4] ..... F02M 1/10

[52] U.S. Cl. ..... 236/75; 236/101 C; 123/516; 261/39.1

[58] Field of Search ..... 236/101 C, 93 R, 101 R, 236/DIG. 12, 75; 261/39.1, DIG. 67; 123/516, 520

[56] References Cited

U.S. PATENT DOCUMENTS 4,577,607 3/1986 Nishio ..... 261/DIG. 67

4,608,208 8/1986 Yogo et al. ..... 236/101 C

*Primary Examiner*—William E. Wayner

*Attorney, Agent, or Firm*—Oblon, Fisher, Spivak, McClelland & Maier

[57] ABSTRACT

A selector valve device for controlling the opening and closing of a fluid passageway in response to both the input current signal and the ambient temperature, especially used for a carbureter outer vent controller of vehicle engines. The valve device is equipped with a metal heat transfer member which contacts with both the core member of an electromagnet for supplying the input current signal and a temperature sensing spring for biasing the valve in the direction for opening the valve, thereby to transfer the heat generated by excitation of the electromagnet to the temperature sensing spring so that the difference between the temperature in the carbureter float chamber and the ambient temperature sensed by the spring is reduced.

3 Claims, 3 Drawing Figures

SELECTOR VALVE DEVICE

BACKGROUND OF THE INVENTION

1. Field of the Invention

The present invention relates to a selector valve device, more particularly a selector valve device that controls the opening and closing of a fluid passageway in response to both an input current signal and the ambient temperature. The device of the present invention is especially used for an apparatus such as a so-called carbureter outer vent controller to prevent the evaporated fuel gas generated in the carbureter float chamber of an automobile engine from being discharged into the atmospheric air.

2. Prior Art

One of the conventional devices of this type is disclosed, for example, in the Japanese Laid-open Patent Publication No. 60382/1985 (Toku-kai-sho 60-60382), which is shown in FIG. 3. This conventional device is equipped with an electromagnetic mechanism including outer periphery yoke 40 comprising a magnetic material fixed to the right side end of body 31, inner core 43 disposed on the center axis in the outer periphery yoke, bobbin 44 made of non-magnetic material inserted and fixed to the outer periphery of the inner core 43, solenoid coil 47 wound on said bobbin, plunger 49 disposed movably in the axial direction facing said core on the same axis of the aforementioned inner core 43, and shaft 51, one end of which is fixed to said plunger and the other end is disposed facing the valve body 36; and a temperature sensing mechanism including first spring 37 for biasing the valve body 36 in the direction of closing the valve, and second spring made of shape memory alloy and stretchable to the memorized shape at a high temperature to bias valve body 36 in the direction of opening the valve through the shaft. When the ignition switch is turned on, solenoid coil 47 is excited regardless of the temperature change in the carbureter float chamber, plunger 49 is drawn to inner core 43, shaft 51 fixed to said plunger 49 compresses second spring 54 to move rightward in the figure, and disengages from valve body 36, so that said valve body 36 is brought into contact with sheet member 38 by the biasing force of first spring 37 so as to shut off communication between inlet port 32 and outlet port 33.

When the ignition switch is turned off and the carbureter float chamber is at a high temperature (higher than 50° C.), second spring 54 made of shape memory alloy expands to the memorized shape and biases valve body 36 in the direction of opening the valve through the shaft. Here, the load is set at a larger value than that of first spring 37, so that valve body 36 disengages from sheet member 38 and inlet port 32 and outlet port 33 communicate with each other.

When the carbureter float chamber is at a low temperature, valve body 36 and, through valve body 36, shaft 51 and plunger 49 shrink second spring 54 by the biasing force of first spring 37 shown at the right in the figure, of which load is set at a larger value than that of second spring 54, and the valve body is moved until it comes into contact with sheet member 38. Thus the communication between inlet port 32 and outlet port 33 is shut off.

In the conventional device in FIG. 3 described above, when the ignition switch is turned off, there is a difference between the temperature in the carbureter float chamber to control the opening and closing of the valve body and the ambient temperature which expands the second spring made of shape memory alloy and which actually controls the opening and closing of the valve body when the valve body moves between the valve opening position and the valve closing position because of the temperature change in the carbureter float chamber. Consequently, the carbureter outer vent device does not operate because the ambient temperature of the second spring is lower than the set temperature though the temperature in the carburetor float chamber is higher than the set temperature of the changeover valve, resulting in the problem that the restarting capability of the engine at high temperature deteriorates.

SUMMARY OF THE INVENTION

The object of the present invention is to provide a switch valve which can reduce the difference between the temperature in the carbureter float chamber, by which the opening and closing of the valve body shall be controlled and the detected ambient temperature of the second spring made of shape memory alloy, by which the opening and closing of the valve body is actually controlled.

In accordance with the present invention, there is inserted a metal heat transfer member between the inner core and the body; the flange formed at one end of said metal heat transfer being brought into intimate contact with the flange of said inner core and the other end of said metal heat transfer member being fixed to one end of said second spring.

Since one end of the metal heat transfer member is in intimate contact with the flange of the inner core, the temperature of the second spring itself is increased because the heat generated when the solenoid coil is excited by turning on the ignition switch is conducted from the inner core to the second spring made of shape memory alloy through the metal heat transfer member, whereby it becomes possible to reduce the temperature difference from the temperature in the carbureter float chamber when the valve body is changed over to the valve opening position.

Thus, the starting capability after prolonged inactivity due to the extended time during which the selector valve is opened is not deteriorated and the problem that the carbureter outer vent controller does not operate can be solved because the temperature of the second spring is lower than the set temperature though the temperature in the carbureter float chamber is higher than the set temperature of the selector valve.

Incidentally, it is conceivable as an alternative to wind a solenoid coil around the spring made of shape memory alloy to heat the spring itself. But, in this case, there is a risk of the spring being twisted and the valve body not performing open/close operation correctly. Thus, in the present invention, the heat generated in the electromagnetic mechanism is conducted to the spring made of shape memory alloy through the heat pipe fixed by press-fitting to the body and the heat pipe has the function of the spring retainer, so that the valve body is free from malfunctioning due to the twisted spring or other.

The foregoing and other objects, features and advantages of the present invention will be understood more clearly and fully from the following detailed description of preferred embodiments with reference to the attached drawings.

DESCRIPTION OF THE PREFERRED EMBODIMENT

Figure 1:
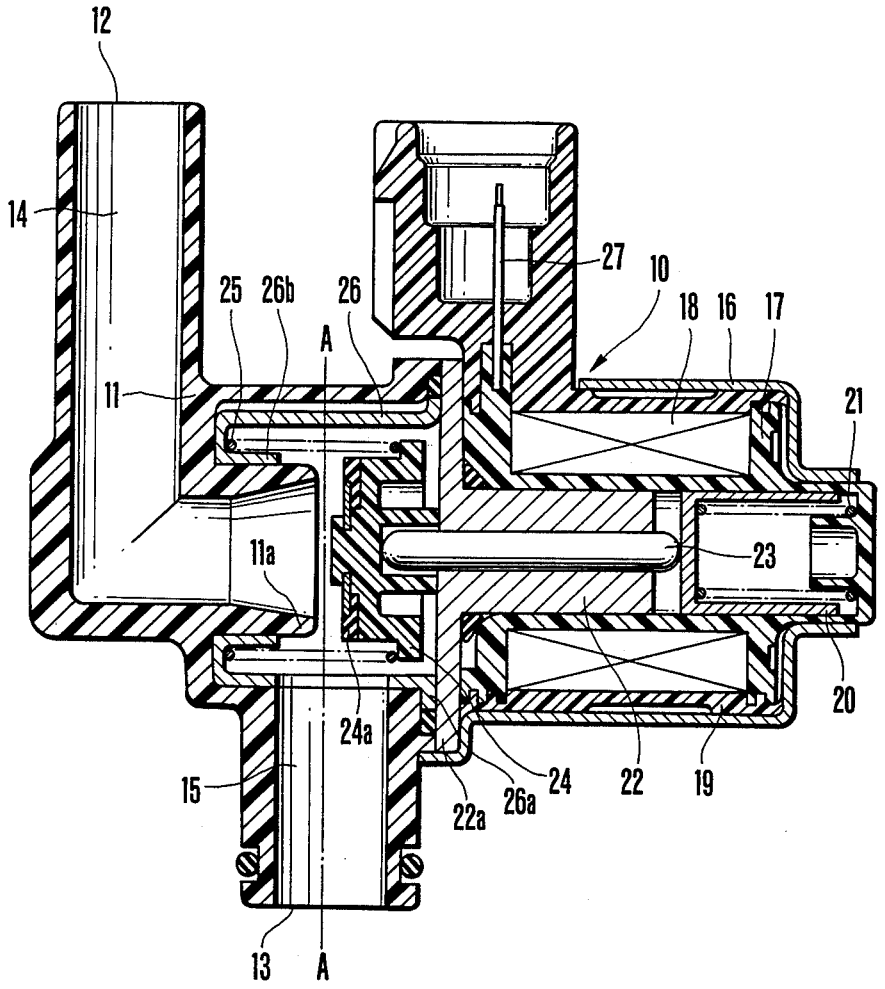
FIG. 1 shows a sectional view of one embodiment of selector valve device in accordance with the present invention.
Figure 2:
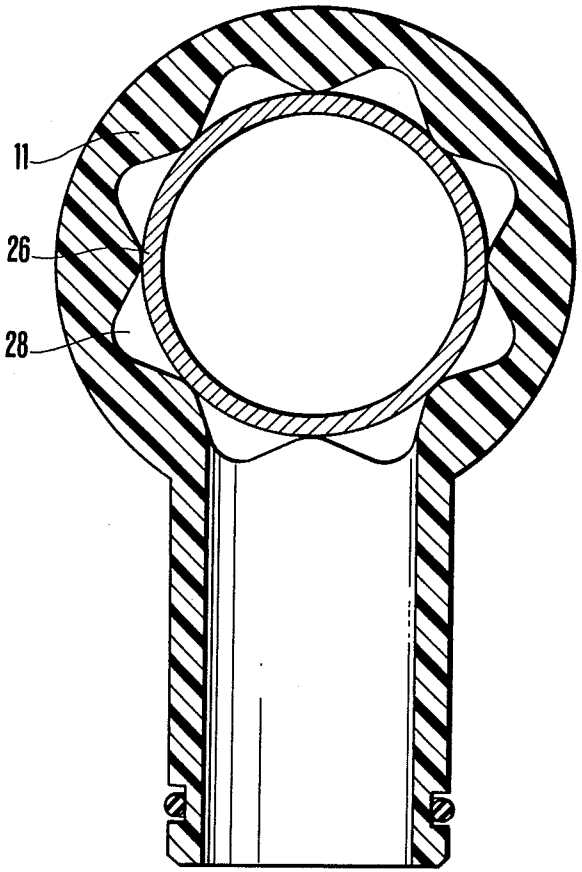
FIG. 2 shows an enlarged cross sectional view taken on line A—A in FIG. 1.
Figure 3:
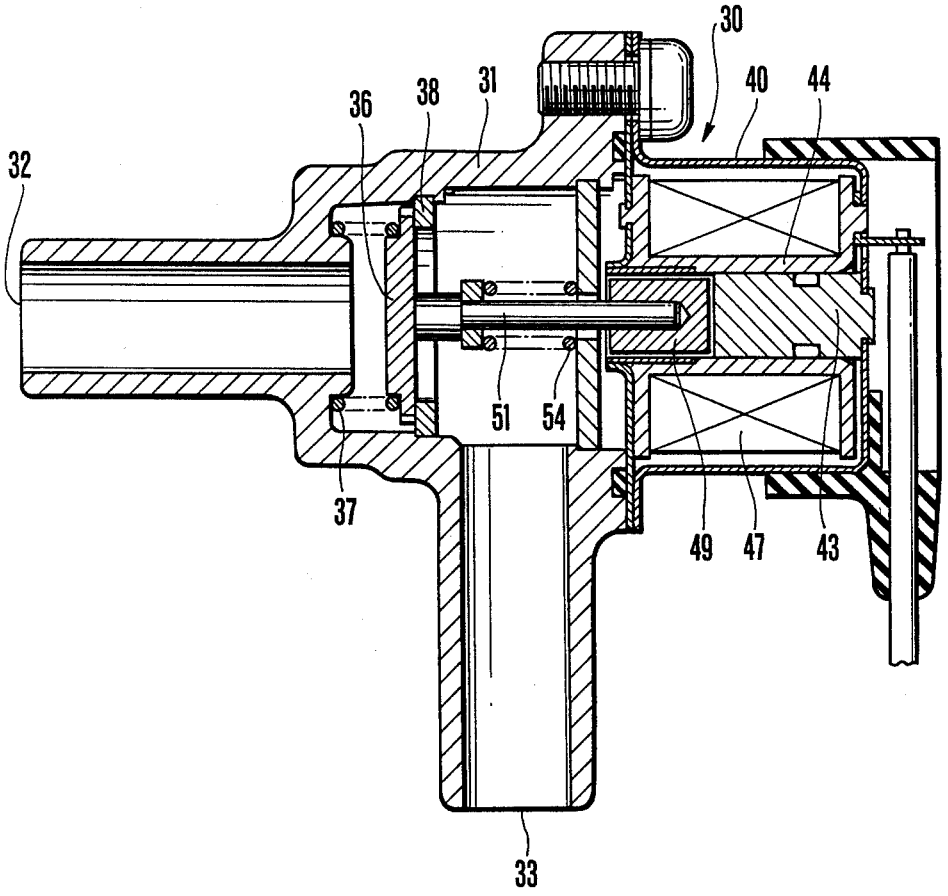
FIG.3 PRIOR ART
FIG. 3 shows a sectional view of a conventional selector valve device.

Referring to FIGS. 1 and 2, selector valve 10 is provided with inlet port 12 that communicates to the carbureter float chamber and outlet port 13 that communicates to the canister in body 11 in an outer vent controller. Both ports 12 and 13 communicate into body 11 through fluid passageways 14 and 15 valve body 24 is disposed between said passageways 14 and 15 and the opening and closing of the passageway between both ports 12 and 13 are controlled by said valve body 24.

To the right side end of body 11 is fixed an outer periphery yoke 16 made of magnetic material, and on the center axis of said outer periphery yoke 16 is disposed an inner core 22 having flange 22*a*. On the outer periphery of said inner core 22 is inserted and fixed a bobbin 17 made of non-magnetic material. Solenoid coil 18 is wound on said bobbin 17. On the outer periphery of said coil 18 is provided a resin mold 19 for making the coil impervious to moisture and for its protection. Both ends of said coil 18 are connected to an appropriate power supply through the terminal 27. Between the inside of the right end surface of the bobbin and inner core 22 is disposed a plunger 20 on the same axis as that of said inner core 22 facing said core 22 and movable in the axial direction. A shaft 23 of which one end is in contact with the end surface of said plunger 20 passes through the void of inner core 22, and the other end is fixed to a valve body 24. Between the plunger and the inside of the right side end of bobbin 17 is disposed a first spring 21, one end of which is fixed to said bobbin 17, to bias valve body 24 in the closing direction through plunger 20 and shaft 23.

In body 11, a heat pipe 26 made of brass as a heat transfer member is fixed by press-fitting and one end is in contact with flange 22*a* of inner core 22, while the other end holds one end of a second spring 25 that biases valve body 24 in the opening direction against the biasing force of first spring 21. Second spring 25 is made of shape memory alloy and, at a low temperature, the load of first spring 21 is set at a larger value that that of second spring 25, and valve body 24 is held in the valve closing position. At a high temperature (approximately 60° C. or higher), since second spring 25 is so constructed as to expand to the memorized shape, the load of the second spring is set so that it becomes larger than that of first spring 21, and valve body 24 is held in the valve opening position.

On one end of the heat pipe 26 made of brass, which is fixed to body 11, there is provided a flange 26*a*, said flange 26*a* being held between flange 22*a* of inner core 22 and body 11. On the other end of heat pipe 26, there is provided a bent section 26*b*, said bent section 26*b* being in contact with the interior of the second spring. The contact area between each member is made large so that the heat generated when the solenoid coil is excited is conducted efficiently to the second spring. The interior of body 11 into which the heat pipe is fixed is corrugated as shown in FIG. 2, thereby not only the press-fitting and assembling abilities of said heat pipe 26 are improved but also heat insulation of heat pipe 26 are improved by provision of void 28 between body 11 and heat pipe 26.

In the device having the aforementioned construction, when the ignition switch is turned on and solenoid coil 18 is excited, a magnetic circuit is formed between outer periphery yoke 16 and inner core 22 by the exciting action of said solenoid coil 18, and plunger 20 located in said magnetic circuit is attracted to said core. Thereby, valve body 24 of which one end is fixed to the other end of shaft 23 in contact with said plunger forms an integral part with said shaft and moves leftward in the figure and brings seal 24*a* of valve body 24 into contact with sheet surface 11*a* of body 11 to hold the valve closing position. As described above, when the ignition switch is turned on, the communication between the carbureter float chamber and the canister is shut off regardless of the temperature in the carbureter float chamber. The heat generated by coil excitation is conducted from inner core 22 to second spring 25 through heat pipe 26.

When the ignition switch is turned off and solenoid coil 18 is not excited, valve body 24 moves by the balance between the biasing force of the first spring and that of the second spring. When the temperature in the carbureter float chamber is low, valve body 24 is biased in the direction of closing the valve through plunger 20 and shaft 23 by the leftward biasing force of first spring 21 shown in the figure, of which load is set at a larger value than that of the second spring, and seal 24*a* of valve body 24 comes into contact with sheet surface 11*a* of body 11 to be held in the valve closing position. Since the communication between both ports 12 and 13 are shut off, the communication between the canister and the carbureter float chamber is shut off.

When the temperature in the carbureter float chamber is high (higher than 60° C.), second spring 25 elongates to the memorized shape and seal 24*a* of the valve body 24 comes off the sheet surface 11*a* of the body 11 because of the rightward biasing force of the second spring 25 shown in the figure of which load is set at a value larger than that of first spring 25 and is held in the valve opening position, thereby both ports 12 and 13 communicating with each other.

When the temperature in the carbureter float chamber is high (i.e., higher than 60° C.), the ignition switch is turned on and the heat generated when solenoid coil 18 is excited is conducted to second spring 25 through the heat pipe 26, so that the temperature in second spring 25 becomes higher than that of the carbureter float chamber, and the outer vent controller can be operated securely corresponding to the temperature in the carbureter float chamber even if the ambient temperature of second spring 25 has actually become lower than the set temperature of the changeover valve. Also the time required for valve body 24 to cool down to the temperature at which it returns to the valve closing position becomes almost equal because the temperature in the carbureter float chamber and the ambient temperature of the second spring differ in the lowering rate.

It should be understood that, although the preferred embodiment of the present invention has been described herein in considerable detail, certain modifications, changes, and adaptations may be made by those skilled in the art and that it is hereby intended to cover all modifications, changes and adaptations thereof falling within the scope of the appended claims.

What is claimed is:

1. In a selector valve device comprising; a body having an inlet port and an outlet port, a fluid passageway communicating with said inlet port and outlet port, a valve to open and close said fluid passageway, an outer periphery yoke made of magnetic material and fixed to said body, an inner core disposed on the axis of said outer yoke, a bobbin made of non-magnetic material and fixed to the outer periphery of said inner core, a solenoid coil wound on said bobbin and forming a magnetic circuit with said outer periphery yoke and inner core, a plunger disposed in said magnetic circuit and attracted by said inner core when said solenoid coil energized, a shaft for connecting said plunger with said valve at the operation time, a first spring biasing said valve to its closed position through said shaft, and a second spring biasing said valve to an opened position resisting the biasing force of said first spring, said second spring being made of shape-memory alloy so as to expand to a memorized shape at high temperature, an improvement wherein:

a metal heat transfer member is disposed between said inner core and said body, a first end of said metal heat transfer member being formed as a flange portion and closely contacted to the flange portion of said inner core, and a second end of said metal heat transfer member being contacted to one end of said second spring.

2. A selector valve device as set forth in claim 1, wherein the inner surface of said body and the outer surface of said heat transfer member have a gap formed therebetween, thereby to improve heat insulation of the heat transfer member.

3. A selector valve device as set forth in claim 1, wherein heat generated by excitation of the solenoid coil is transferred to said second spring through said metal heat transfer member from the inner core.

* * * * *